US008851780B1

(12) United States Patent
Morgan, Jr.

(10) Patent No.: US 8,851,780 B1
(45) Date of Patent: Oct. 7, 2014

(54) TOOTHPASTE DISPENSER AND BRUSH

(76) Inventor: Stephen A. Morgan, Jr., Houma, LA (US)

( * ) Notice: Subject to any disclaimer, the term of this patent is extended or adjusted under 35 U.S.C. 154(b) by 496 days.

(21) Appl. No.: 13/283,629

(22) Filed: Oct. 28, 2011

(51) Int. Cl.
*A46B 11/04* (2006.01)

(52) U.S. Cl.
USPC ..... 401/282; 401/272; 401/179; 401/181

(58) Field of Classification Search
USPC ..... 401/270, 272, 282, 176, 179, 181
See application file for complete search history.

(56) References Cited

U.S. PATENT DOCUMENTS 3,728,035 A * 4/1973 Reitknecht ..... 401/175
3,995,648 A * 12/1976 Kuryla ..... 401/173
5,208,933 A * 5/1993 Lustig et al. ..... 15/22.1
5,636,933 A * 6/1997 Vizsolyi ..... 401/269

* cited by examiner

*Primary Examiner* — David Walczak
(74) *Attorney, Agent, or Firm* — Dave Alan Lingbeck

(57) ABSTRACT

A toothpaste dispenser & brush for compelling kids to brush their teeth wherever by making it interesting and fun. The toothpaste dispenser & brush includes a toothpaste container; a toothpaste dispensing assembly for dispensing toothpaste from the toothpaste container; and a brush assembly being removably supported to the toothpaste container.

7 Claims, 4 Drawing Sheets

TOOTHPASTE DISPENSER AND BRUSH

BACKGROUND OF THE INVENTION

1. Field of the Invention

The present invention relates to toothpaste dispensers and more particularly pertains to a new toothpaste dispenser & brush for compelling kids to brush their teeth wherever by making it interesting and fun.

2. Description of the Prior Art

The use of toothpaste dispensers is known in the prior art. More specifically, toothpaste dispensers heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a household apparatus for dispensing toothpaste from a tube of toothpaste. The apparatus is a toothpaste dispenser which is removably mounted to a wall surface. The tube of toothpaste is mounted within the dispenser and can have a small volume of toothpaste dispensed by pushing inward on a plunger that is connected to the toothpaste dispenser. Another prior art includes a dispenser pump e.g. for toothpaste has a plunger connected to a proximal end of an elongate flexible plastics strip which is run slidably along a guide track built into the discharge nozzle of the pump alongside the discharge channel. The distal end of the guide track defines a bend which opens through a lateral slot into the discharge channel just inside its external opening. Action of the plunger causes the strip to slide back and forth along the track and round the bend, so that the tip of the strip is moved out of the mouth of the nozzle during dispensing but returns to block it and cut away residual product when the plunger is released. Also, another prior art includes the travel toothbrush with incremental toothpaste dispenser comprising: a main housing with open inboard and outboard ends, the main housing having an inner surface with diametrically spaced detents, a toothbrush having a brush head and a reservoir affixed to the open inboard end of the main housing, the brush head having a base including a plurality of bristles and a central channel extending therein, the channel being in communication with the reservoir, a plurality of bores being positioned in the base and in communication with the central channel; and a plunger formed in an elongated configuration with inboard and outboard ends, a rubber piston being rotatably coupled to the inboard end, the plunger having an outer surface including a plurality of diametrically opposing pairs of indents, the plunger being positioned within the main housing with indents being coupled to detents of the main housing to lock the plunger in a stable orientation, in operation the main housing being filled with toothpaste and a user pressing the plunger to force toothpaste onto the bristles.

While these devices fulfill their respective, particular objectives and requirements, the aforementioned patents do not disclose a new toothpaste dispenser & brush.

SUMMARY OF THE INVENTION

The general purpose of the present invention, which will be described subsequently in greater detail, is to provide a new toothpaste dispenser & brush which has many of the advantages of the toothpaste dispensers mentioned heretofore and many novel features that result in a new toothpaste dispenser & brush which is not anticipated, rendered obvious, suggested, or even implied by any of the prior art toothpaste dispensers, either alone or in any combination thereof. The present invention includes a toothpaste container; a toothpaste dispensing assembly for dispensing toothpaste from the toothpaste container; and a brush assembly being removably supported to the toothpaste container. None of the prior art includes the combination of the elements of the present invention.

There has thus been outlined, rather broadly, the more important features of the toothpaste dispenser & brush in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new toothpaste dispenser & brush which has many of the advantages of the toothpaste dispensers mentioned heretofore and many novel features that result in a new toothpaste dispenser & brush which is not anticipated, rendered obvious, suggested, or even implied by any of the prior art toothpaste dispensers, either alone or in any combination thereof.

Still another object of the present invention is to provide a new toothpaste dispenser & brush for compelling kids to brush their teeth wherever by making it interesting and fun.

Still yet another object of the present invention is to provide a new toothpaste dispenser & brush that is all self contained and easy and effective to use.

Even still another object of the present invention is to provide a new toothpaste dispenser & brush that readies itself for dispensing toothpaste automatically to make it simple for children to simply press on the lever to dispense the toothpaste without having to prime or pump it.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
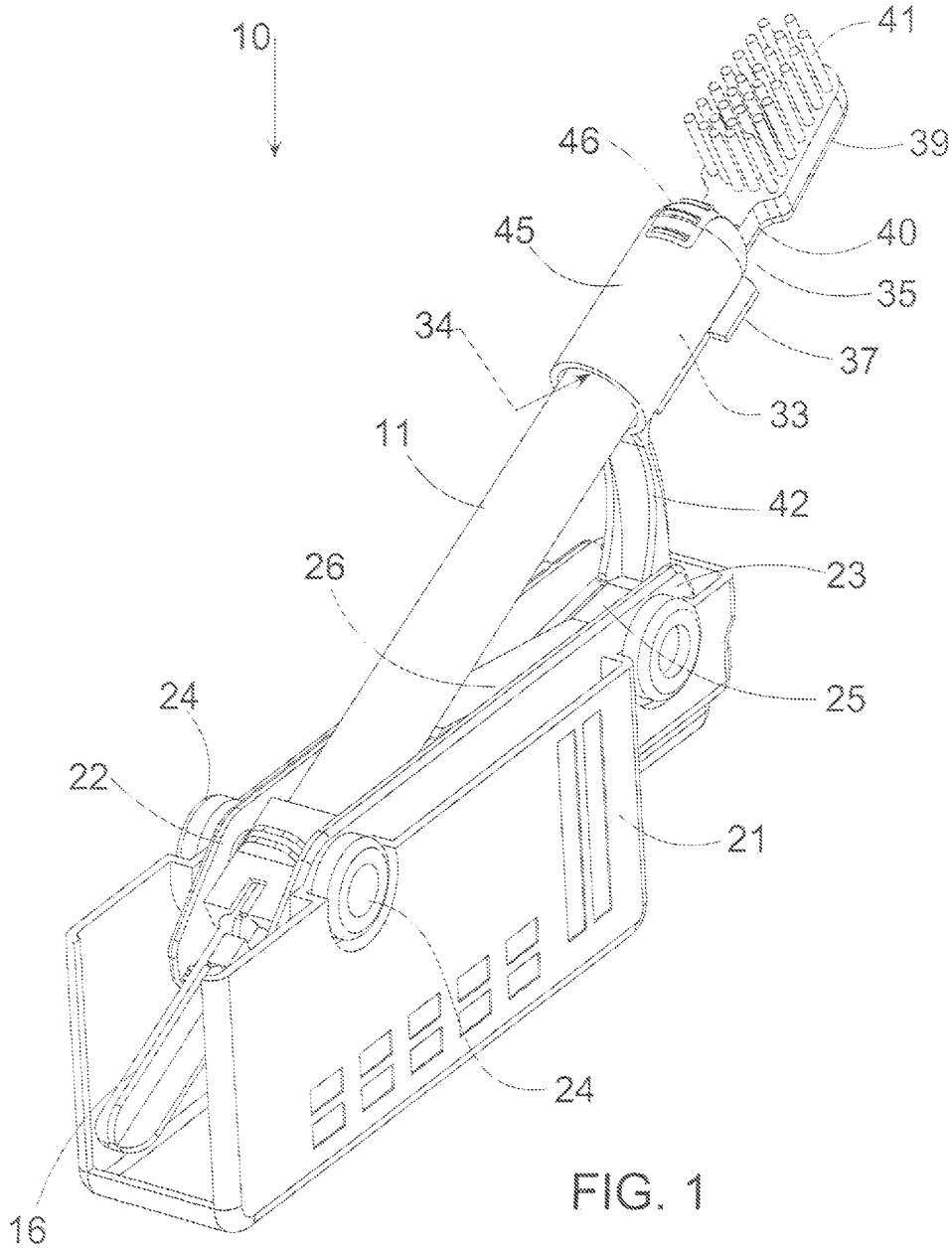
FIG. 1 is a bottom perspective view of the toothpaste dispenser and brush.
Figure 2:
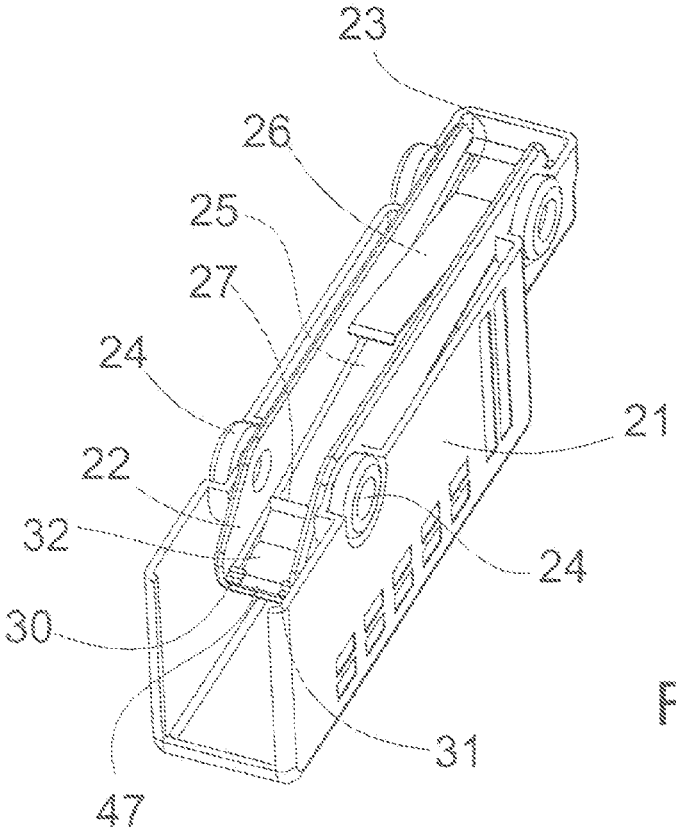
FIG. 2 is a bottom perspective view of the lever which includes the school bus.
Figure 3:
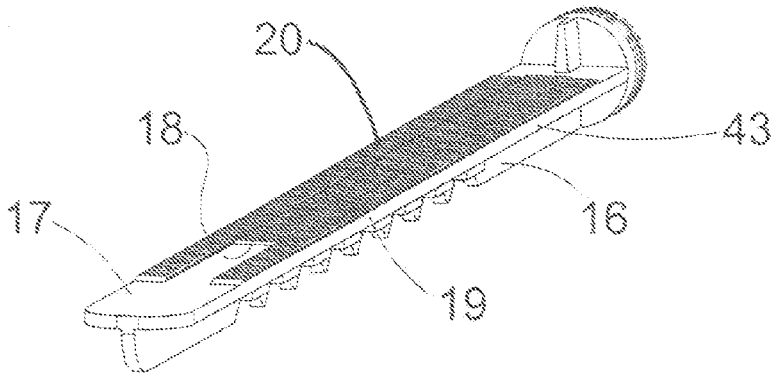
FIG. 3 is a top perspective view of the plunger.
Figure 4:
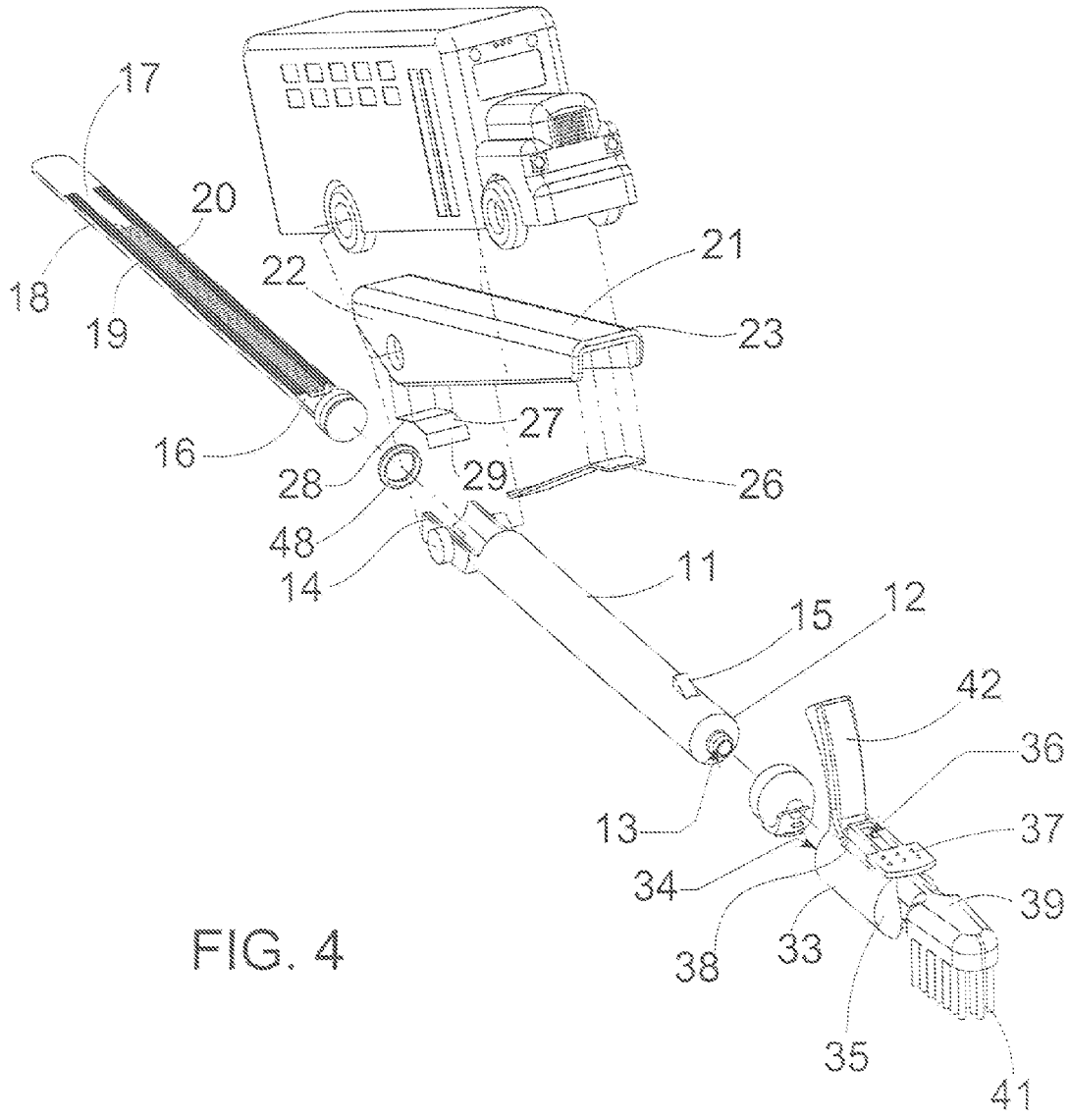
FIG. 4 is an exploded top perspective view of the toothpaste dispenser and brush.
Figure 5:
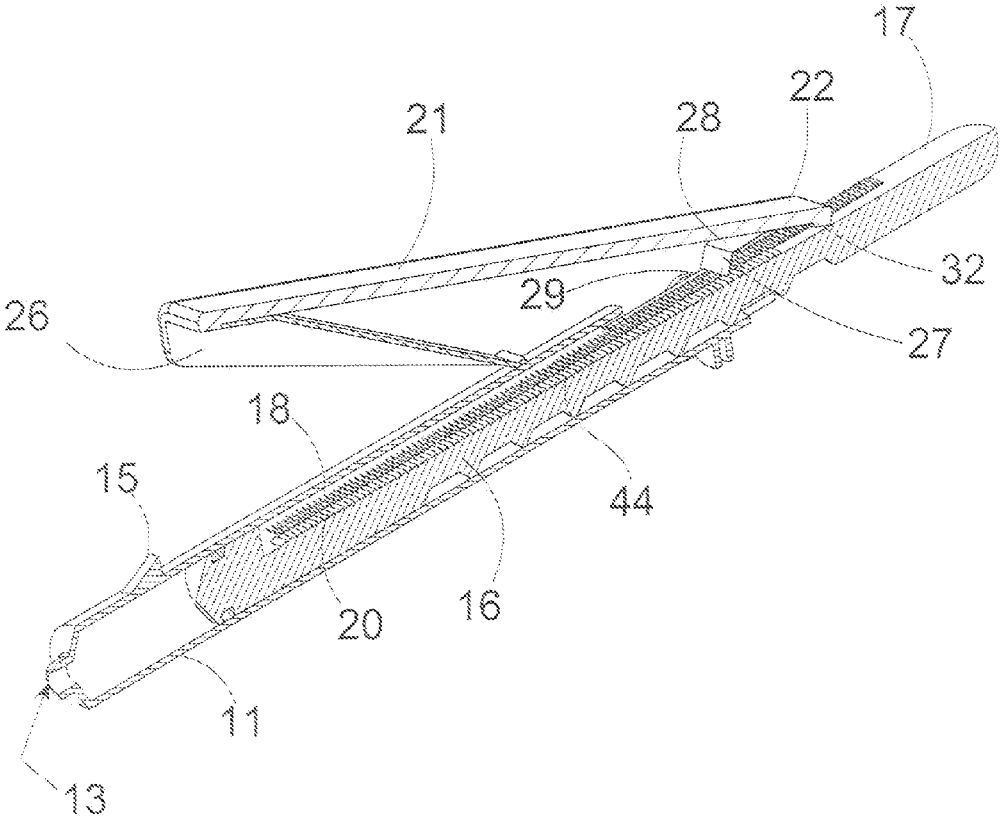
FIG. 5 is a cross sectional top perspective view of the oval-shaped tube with the plunger disposed therein and the lever.

With reference now to the drawings, and in particular to FIGS. 1 through 5 thereof, a new toothpaste dispenser & brush embodying the principles and concepts of the present invention and generally designated by the reference numeral 10 will be described.

As best illustrated in FIGS. 1 through 5, the toothpaste dispenser & brush 10 generally comprises a toothpaste container 11, a toothpaste dispensing assembly for dispensing toothpaste from the toothpaste container 11, and a brush assembly being removably supported to the toothpaste container. The toothpaste container includes a tubular member 11 having a dispensing end 12 with a hole 13 being disposed therethrough, and also having an open plunger-receiving end 14.

The toothpaste dispensing assembly includes a plunger 16 with an O-ring 48 being conventionally disposed thereabout, being movably disposed in the tubular member 11 through the open plunger-receiving end 14 with the plunger having front and back ends. The plunger has a first plurality of teeth 18 being spaced apart and being arranged side by side to form a first track being conventionally disposed on a wall 17 thereof and extending along a substantial length of the wall 17 and terminating short of the front end of the plunger 16. The first plurality of teeth 18 are slanted forwardly and are spaced from the longitudinal edges 43,44 of the wall 17 of the plunger 16. The plunger 16 further includes second and third plurality of teeth 19,20 arranged to form second and third tracks being conventionally disposed to either side of the first track 18 and along the longitudinal edges 43,44 of the wall 17 of the plunger 16. The toothpaste dispensing assembly also includes a lever 21 having a proximate end 22 being pivotally and conventionally attached to the tubular member 11 near the open plunger-receiving end 14 thereof. The toothpaste dispensing assembly further includes a leaf spring 26 having an end being securely and conventionally attached to and depending from an underside 25 of the lever 21 near a distal end 23 thereof and being engagable to the tubular member 11 for pivotally retracting the lever 21 away from the tubular member 11. The toothpaste dispensing assembly also includes a plunger drive member 27 being conventionally attached at the proximate end 22 of the lever 21 and being engagable to the first track 18 for moving the plunger 16 toward the dispensing end 12 of the tubular member 11. The plunger drive member 27 has a first planar portion 28 being conventionally attached to the proximate end 22 of the lever 21 and also has a second planar portion 29 integrally extending from and being angled relative to the first planar portion 28 and being engagable to the first track 18. The toothpaste dispensing assembly further includes plunger tracking cogs 30,31 being disposed about a shaft 47 which is transversely disposed and conventionally connected at the proximate end 22 of the lever 21 and being engagable to the second and third tracks 19,20 for guiding the plunger 16 in the tubular member 11. The toothpaste dispensing assembly also includes a plunger stop member 32 being conventionally disposed and attached at the proximate end 22 of the lever 21 and adjacent to and behind the plunger drive member 27 and being engagable to the first track 18 of the plunger 16 upon the lever 21 being retracted by the leaf spring 26 to prevent the plunger 16 from moving rearwardly of the tubular member 11. The lever 21 is shaped like that of a bus with the bus having rear wheels 24 which are pivotally and conventionally supported by the tubular member 11 to allow the bus to pivotally move relative to the tubular member 11.

The tooth brush assembly includes a cap 33 having an open end 34 and a closed end 35 with the dispensing end 12 of the tubular member 11 being removably received in the cap 33 through the open end 34. The brush assembly also includes a brush member 39 having a stem 40 being conventionally attached and plastic welded to and extending from the closed end 35 of the cap 33, and further includes bristles 41 being conventionally disposed and arranged upon the brush member 39 adjacent to the stem 40 for brushing one's teeth. The brush assembly also includes a biased fastener 37 being pivotally and conventionally attached with a rivet to the cap 33 and having a clip portion 38 being integrally disposed at an end thereof and being biasedly disposed in an opening 36 through a side wall 45 of the cap 33 for securing the cap 33 to and also releasing the cap 33 from the tubular member 11. The brush assembly further includes a pedestal 42 having a bottom end being conventionally attached and plastic welded to the side wall 45 of the cap 33 and extending outwardly therefrom with the pedestal 42 supporting a distal end 23 of the lever 21 upon the lever 21 being retracted away from the tubular member 11 to guard against actuation of the plunger 16 and dispensing of toothpaste from the tubular member The tubular member 11 has a node 15 being conventionally disposed on an outer surface of the tubular member 11 near the dispensing end 12 thereof and being engagable to the clip portion 38 of the biased fastener 37. The brush assembly further includes a grip member 46 such as a rubber pad having ribs being spaced apart and being disposed thereon with the grip member 46 being conventionally disposed upon the side wall 45 of the cap 33 opposite the opening 36 for a user to grasp when using the brush member 39.

In use, the user removes the cap 33 from the dispensing end 12 of the tubular member 11 by depressing upon a portion of the biased fastener 37 to disengage the clip portion 38 from the node 15. The user then holds the brush assembly in particular the cap 33 and the grip member 46 and positions the dispensing end 12 of the tubular member 11 upon the bristles 41 of the brush member 39, and presses the distal end 23 of the lever 21 towards the tubular member 11 whereupon the plunger drive member 27 engages the first track 18 and moves the plunger 16 towards the dispensing end 12 of the tubular member 11 thus forcing a selected amount toothpaste from inside the tubular member 11 through the hole 13 in the dispensing end 12 of the tubular member 11 and onto the bristles 41. The user then releases the lever 21 and the leaf spring 26 engages the tubular member 11 and urges the lever 21 pivotally away from the tubular member 11 with the plunger stop member 32 engaging the first track 18 as the lever 21 pivoting about the proximate end 22 and thus preventing backward movement of the plunger 16. The user then places the cap 33 upon the dispensing end 12 of the tubular member 11 with the clip portion 38 of the biased fastener 37 engaging the node 15 on the tubular member 11 to secure the cap 33 to the tubular member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the toothpaste dispenser & brush. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothpaste dispenser & brush comprising:

a toothpaste container includes a tubular member having a dispensing end with a hole being disposed therethrough, and also having an open plunger-receiving end;

a toothpaste dispensing assembly for dispensing toothpaste from said toothpaste container, wherein said toothpaste dispensing assembly includes a plunger being movably disposed in said tubular member through said open plunger-receiving end, wherein said plunger has a first plurality of teeth arranged to form a first track being disposed on a wall thereof and extending along a substantial length of said wall, wherein said plunger further includes second and third plurality of teeth arranged to form second and third tracks being disposed to either side of said first track and along said longitudinal edges of said wall of said plunger; and a brush assembly being removably supported to said toothpaste container.

2. A toothpaste dispenser & brush comprising a toothpaste container includes a tubular member having a dispensing end with a hole being disposed therethrough, and also having an open plunger-receiving end;

a toothpaste dispensing assembly for dispensing toothpaste from said toothpaste container, wherein said toothpaste dispensing assembly includes a plunger being movably disposed in said tubular member through said open plunger-receiving end, wherein said plunger has a first plurality of teeth arranged to form a first track being disposed on a wall thereof and extending along a substantial length of said wall, wherein said toothpaste dispensing assembly also includes a lever having a proximate end being pivotally attached to said tubular member near said open plunger-receiving end thereof, wherein said toothpaste dispensing assembly further includes a leaf spring depending from said lever and being engagable to said tubular member for pivotally retracting said lever away from said tubular member; and a brush assembly being removably supported to said toothpaste container.

3. The toothpaste dispenser & brush as described in claim 2, wherein said toothpaste dispensing assembly also includes a plunger drive member being attached at said proximate end of said lever and being engagable to said first track for moving said plunger toward said dispensing end of said tubular member.

4. The toothpaste dispenser & brush as described in claim 3, wherein said plunger drive member has a first planar portion being attached to said proximate end of said lever and also has a second planar portion extending from and being angled relative to said first planar portion and being engagable to said first track.

5. The toothpaste dispenser & brush as described in claim 3, wherein said toothpaste dispensing assembly also includes a plunger stop member being disposed at said proximate end of said lever and adjacent to said plunger drive member and being engagable to said first track of said plunger upon said lever being retracted by said leaf spring to prevent said plunger from moving rearwardly of said tubular member.

6. The toothpaste dispenser & brush as described in claim 1, wherein said toothpaste dispensing assembly also includes a lever having a proximate end being pivotally attached to said tubular member near said open plunger-receiving end thereof, wherein said toothpaste dispensing assembly further includes plunger tracking cogs being disposed about a shaft which is transversely disposed at said proximate end of said lever and being engagable to said second and third tracks for guiding said plunger in said tubular member.

7. A toothpaste dispenser & brush comprising:

a toothpaste container includes a tubular member having a dispensing end with a hole being disposed therethrough, and also having an open plunger-receiving end;

a toothpaste dispensing assembly for dispensing toothpaste from said toothpaste container, wherein said toothpaste dispensing assembly includes a plunger being movably disposed in said tubular member through said open plunger-receiving end, wherein said plunger has a first plurality of teeth arranged to form a first track being disposed on a wall thereof and extending along a substantial length of said wall, wherein said toothpaste dispensing assembly also includes a lever having a proximate end being pivotally attached to said tubular member near said open plunger-receiving end thereof, wherein said lever is shaped like that of a bus with said bus having rear wheels which are pivotally supported by said tubular member to allow said bus to move pivotally relative to said tubular member; and a brush assembly being removably supported to said toothpaste container.

* * * * *